US008231399B2

(12) United States Patent
Daubigney

(10) Patent No.: US 8,231,399 B2
(45) Date of Patent: Jul. 31, 2012

(54) DEVICE FOR LATCHING A CONNECTOR DEVICE

(75) Inventor: Patrick Daubigney, Authume (FR)

(73) Assignee: CoActive Technologies, LLC, Newton, MA (US)

( * ) Notice: Subject to any disclaimer, the term of this patent is extended or adjusted under 35 U.S.C. 154(b) by 93 days.

(21) Appl. No.: 12/854,609

(22) Filed: Aug. 11, 2010

(65) Prior Publication Data

US 2011/0039440 A1 Feb. 17, 2011

(30) Foreign Application Priority Data

Aug. 11, 2009 (EP) ..... 09167621

(51) Int. Cl.
*H01R 13/213* (2006.01)

(52) U.S. Cl. ..... 439/316; 439/362; 439/247

(58) Field of Classification Search ..... 439/362, 439/316, 247–248
See application file for complete search history.

(56) References Cited

U.S. PATENT DOCUMENTS 4,286,834 A 9/1981 Goodman et al.
5,921,801 A * 7/1999 O'Sullivan et al. ..... 439/362
6,012,939 A * 1/2000 Kunert et al. ..... 439/362
7,083,462 B1 * 8/2006 Chen et al. ..... 439/372
7,210,954 B2 * 5/2007 Ohki et al ..... 439/362
7,377,799 B2 * 5/2008 Kuo ..... 439/362
7,549,885 B1 * 6/2009 Oh et al. ..... 439/316
2004/0014351 A1 1/2004 Endo et al.

FOREIGN PATENT DOCUMENTS

FR 2527015 11/1983
WO 2008145516 A2 12/2008

* cited by examiner

*Primary Examiner* — Truc Nguyen
(74) *Attorney, Agent, or Firm* — Fox Rothschild LLP

(57) ABSTRACT

A latching device for latching a first front connector to a complementary second rear connector. The latching device comprises at least a front latching element supported by the front connector, the front latching element comprising a rear latching segment. The latching device further comprises a rear latching element supported by the rear connector, the rear latching element comprising a front latching segment and being mounted moveable axially from a rear unlatching position to a front latching position in which the front and rear connectors are immobilize axially together, characterized in that the latching device comprises an axial sleeve supported by the rear connector, the sleeve being opened axially towards the front and the rear, the rear latching element being mounted movable axially into the sleeve from its rear unlatching position to its front latching position.

12 Claims, 5 Drawing Sheets

DEVICE FOR LATCHING A CONNECTOR DEVICE

RELATED APPLICATION AND CLAIM OF PRIORITY

This application claims the priority benefit of European Patent Application No. 09167621.3 filed Aug. 11, 2009, the content of which is hereby incorporated by reference.

Not Applicable

BACKGROUND

The invention relates to a device for latching a first front connector to a second rear connector together. More precisely, the invention relates to a device for latching a first front connector to a complementary second rear connector.

In a general way, an electronic apparatus, such as a computer, is connected to at least one peripheral apparatus by a connector device, for example in order to exchange data with the peripheral apparatus. The connector device comprises a first front connector equipped with a series of female pins and a second rear connector equipped with a complementary series of male pins, so that the front and rear connectors are fitted to be connected together.

This kind of connector device is commonly used with electronic apparatus of all kinds because of their rapid connect-disconnect capability. However, it is highly desirable that such a connector device does not disconnect inadvertently since this terminates operation of the associated electronic apparatus.

A device for latching a front connector to a complementary rear connector, to prevent an inopportune and inadvertent disconnection of the connectors, is described in International Patent Publication No. WO2008/145516. The device comprises a front latching element supported by the front connector, and a rear latching element supported by the rear connector.

The front latching element is a female element which delimits a housing opened axially towards the rear and in which are arranged a plurality of latching fingers. Complementarily, the rear latching element is a male element which delimits a latching notch and which is mounted movable axially on the rear connector, from rear to front. The rear latching element is mounted from a rear unlatching position to a front latching position in which the latching fingers are engaged into the notch to axially immobilize the front and the rear connectors together.

The latching device further comprises an unlatching member which is mounted movable axially on the rear latching element, from rear to front, in order to disengage fingers from the notch with a view to unlatch first and second connectors. Moreover, the latching device comprises a multifunction spring for i) returning automatically the rear latching element towards its rear unlatching position and for ii) returning the unlatching member towards the rear.

The multifunction spring comprises a first set of legs for retaining the multifunction spring on the rear connector, a second set of legs for returning the rear unlatching element towards its rear unlatching position, and a third set of legs for returning the unlatching member towards the rear.

An advantage of this latching device is its accessibility for the hand of the user, so that the latching device is convenient and easy to unlatch even if the rear connector, or the front connector, is hardly accessible. However, the multifunction spring comprises a lot of set of thin legs, and thus the multifunction spring might be fragile and difficult to manufacture.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this document is to be construed as an admission that the embodiments described in this document are not entitled to antedate such disclosure by virtue of prior invention. As used in this document, the term "comprising" means "including, but not limited to."

The invention particularly aims to improve the latching device described in WO2008/145516, by proposing a latching device of the type described previously, characterized in that the latching device comprises an axial sleeve supported by the rear connector, said sleeve being opened axially towards the front and the rear, and said rear latching element being mounted movable axially into the sleeve from its said rear unlatching position to its said front latching position.

According to an exemplary embodiment, a latching device for latching a first front connector to a complementary second rear connector, each connector comprising a series of male contact pins and respectively complementary female contact pins, comprises a front latching element supported by the front connector, said front latching element comprising a rear latching segment; and a rear latching element supported by the rear connector, the rear latching element comprising a front latching segment and being mounted moveable axially, from rear to front, relatively to the rear connector, from a rear unlatching position to a front latching position in which the front latching segment of the rear latching element cooperates with the rear latching segment of the front latching element, to immobilize axially the front and rear connectors together, wherein the latching device comprises an axial sleeve supported by the rear connector, the sleeve being opened axially towards the front and the rear, and the rear latching element being mounted movable axially into the sleeve from the rear unlatching position to the front latching position.

BRIEF DESCRIPTION OF THE DRAWINGS

Other features and advantages of the invention will appear from the reading of the detailed description which follows, for the comprehension of which one will refer to the annexed drawings among which.

DETAILED DESCRIPTION

For the detailed description of the invention, and the clarity of the claims, the Vertical, Longitudinal and Transverse orientations according to the reference trihedron V, L, T indicated on the figures, and the orientations axial and radial according to the longitudinal axis A will be used, on a non restrictive basis and without reference to the gravity.

Figure 3:
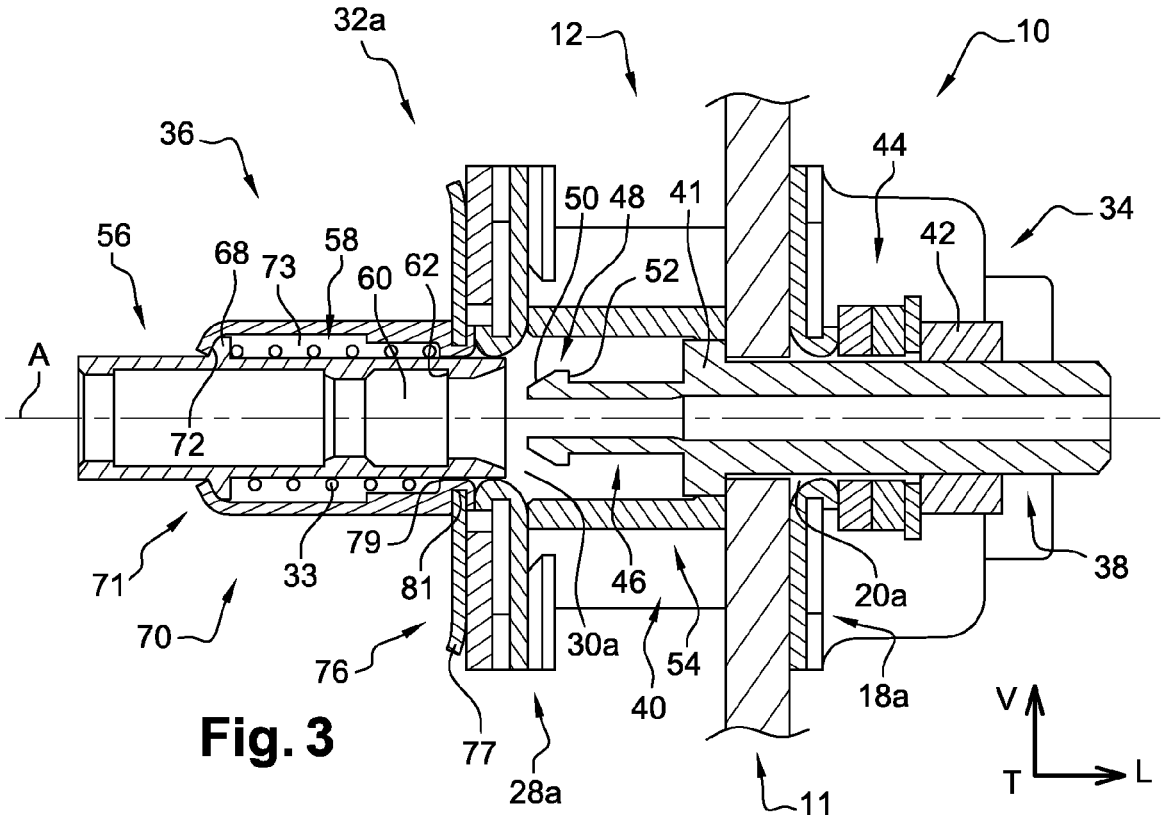
FIG. 3 is a view in section along the line 3-3 of FIG. 1, illustrating the rear latching element of the latching device in a rear unlatching position.

Also, a rear to front orientation, which corresponds to a left to right orientation according to FIG. 3, will be used.

In the following description, identical or similar elements or components will be designated by the same numeral reference.

Figure 1:
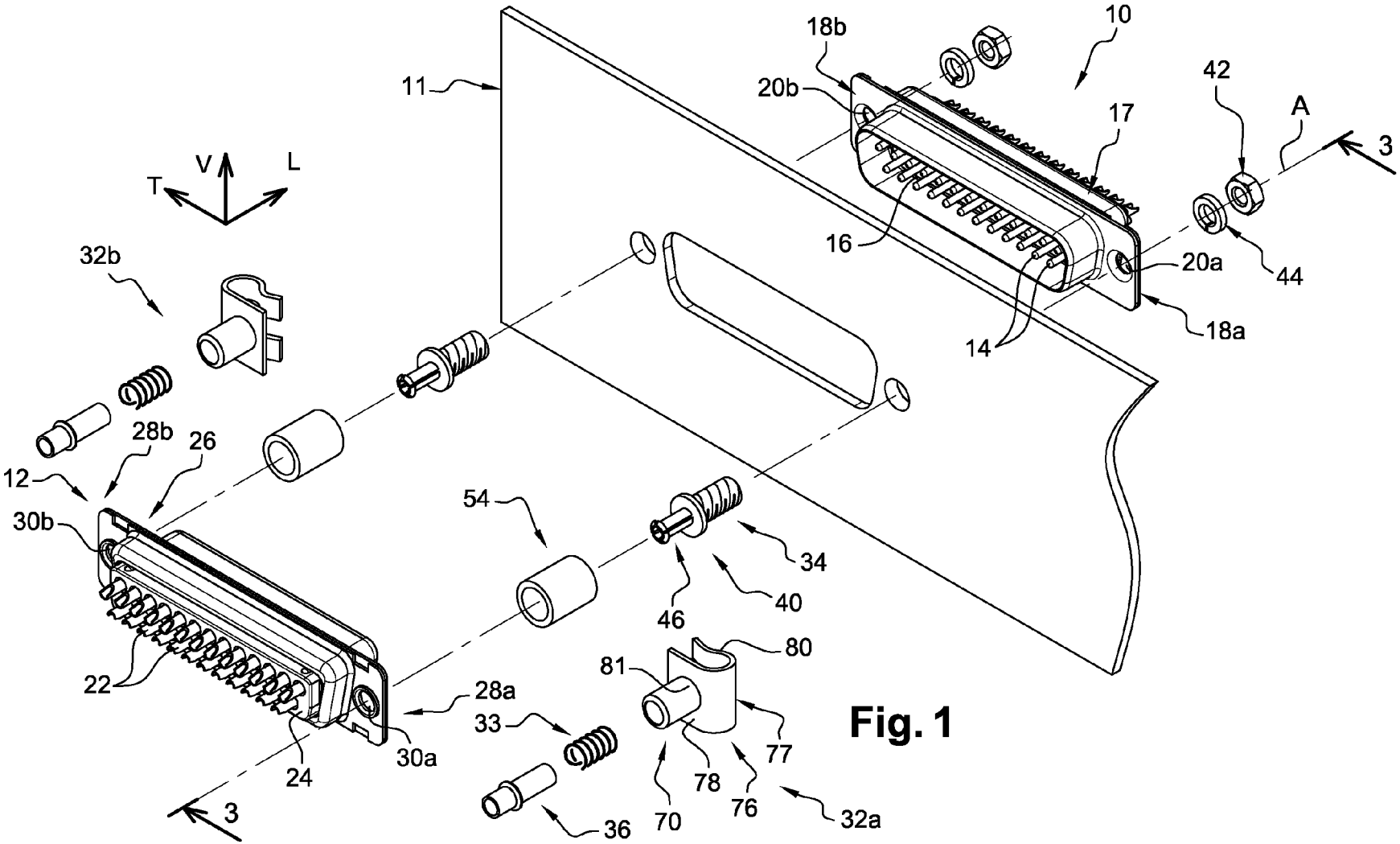
FIG. 1 is a perspective overall exploded view, illustrating a latching device according to a first embodiment of the invention, for latching a first front connector and a second rear connector.

At FIG. 1 there is shown a first front connector 10 fixed on a vertical board 11, and a complementary second rear connector 12, each connector 10, 12 being here a D-Sub type connector.

The front connector 10 may comprise a series of axial longitudinal male contact pins 14 arranged in an internal insulating body 16, the rear part of each male contact pins 14 being adapted to be electrically connected to an associated wire (not illustrated).

The insulating body 16 may be surrounded by an external metal shell 17 which includes a first lateral ear 18*a* and a second lateral ear 18*b*. Each ear 18*a*, 18*b* may extend radially in a vertical and transversal plan, and delimits a hole 20*a*, 20*b* respectively.

Complementarily, the rear connector 12 may comprise a series of axial longitudinal female contact pins 22 arranged in an internal insulating body 24, the rear part of each female contact pins 22 being adapted to be electrically connected to an associated wire (not illustrated).

The insulating body 24 may be surrounded by an external metal shell 26 which includes a first lateral ear 28*a* and a second lateral ear 28*b*. Each ear 28*a*, 28*b* may extend radially in a vertical and transversal plan, and delimits a hole 30*a*, 30*b* respectively.

The front connector 10 and the rear connector 12 are described in additional detail in International Patent Publication No. WO2008/145516.

According to FIG. 1, the front connector 10 and the rear connector 12 may latch together by means of a first latching device 32*a* and a second latching device 32*b*.

The first and the second latching devices 32*a*, 32*b* may be structurally independent from the front connector 10 and the rear connector 12.

Moreover, the first and the second latching devices 32*a*, 32*b* may be identical and may be symmetrically located according to a longitudinal and vertical symmetry plan (not illustrated).

Consequently, for sake of clarity, only the first latching device 32*a* will be described hereafter.

According to a first embodiment, the latching device 32*a* may comprise a front latching element 34 supported by the front connector 10 and a rear latching element 36 supported by the rear connector 12.

With reference to FIG. 3, the front latching element 34 may be globally of a hollow cylindrical shape, according to longitudinal axis A, and it extends axially towards the rear, from a front fixing segment 38 to a rear latching segment 40.

The front fixing segment 38 may be threaded and may extend axially through the board 11 and the ear 18*a* of the front connector 10.

Therefore, the front fixing segment 38 may comprise a shoulder 41 in front axial abutment against the board 11, and a nut 42 in rear axial abutment against the ear 18*a* of the front connector 10, so as to fix the group formed with the front latching element 34, the board 11 and the front connector 10 all together.

Moreover, a plurality of washers 44 may be interposed between the shoulder 41 and the nut 42.

The rear latching segment 40 of the front latching element 34 may comprise four axially elastic latching fingers 46 which are equally angularly spaced around the longitudinal axis A.

The axial free end of each finger 46 may protrude radially to delimit an external tooth 48 which comprises a front chamfered face 50 and a rear radial face 52.

Finally, the front latching element may comprise a hollow cylindrical spacer 54 formed upon the shoulder 41. The spacer 54 may be axially interposed between the board 11 and the ear 28*a* of the rear connector 12, with a view to maintaining a constant space between the board 11 and the rear connector 12. Moreover, the spacer 54 may protect the fingers 46 by surrounding them.

The rear latching element 36 may be globally of a hollow cylindrical shape and may extend axially towards the front according to axis A, from a rear segment 56 to a front latching segment 58.

The front latching segment 58 may extend through the ear 28*a* of the rear connector 12 and delimits a latching housing 60 which is open axially towards the front.

Figure 4:
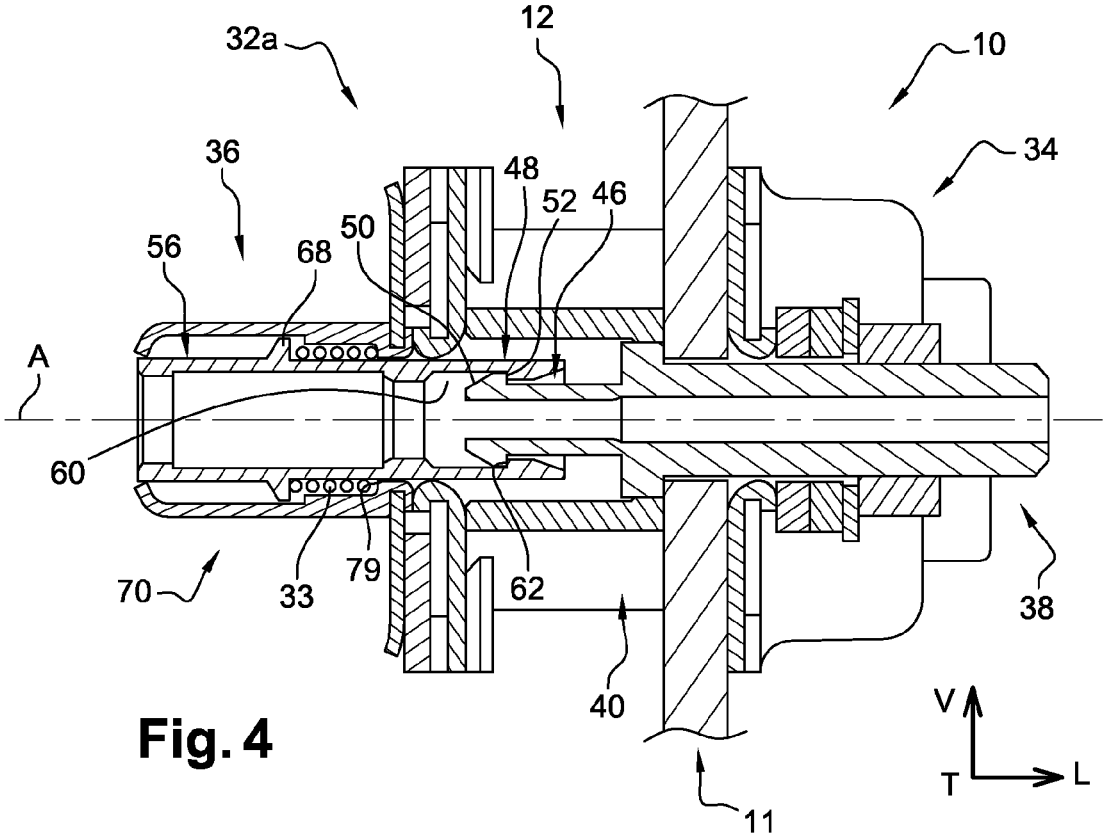
FIG. 4 is a view similar to FIG. 3, illustrating the rear latching element of the latching device in a front latching position.

The latching housing 60 may delimit an internal annular latching notch 62 adapted to fit with the front radial face 52 of the fingers 46, in order to immobilize axially the front and rear connectors 10, 12, according to FIG. 4.

The latching device 32*a* may comprise an axial cylindrical sleeve 70 supported by the rear connector 12 by means of an attachment means 76. The sleeve 70 may delimit a hollow cylindrical housing 73 which is open axially towards the front and the rear. The sleeve 70 may comprise a rear axial tight extremity 71 forming an abutment face 72 adapted to cooperate with the rear latching element 36.

The rear latching element 36 may delimit an annular protuberance 68 that expands radially and which is located between the rear segment 56 and the front segment 58 of the rear latching element 36, the protuberance 68 being adapted to cooperate with the abutment face 72.

At the opposite, the sleeve 70 may comprise a front axial extremity which is open towards the hole 30*a* of the ear 28*a* and which delimits an external groove 74 cooperating with the attachment means 76.

Figure 2:
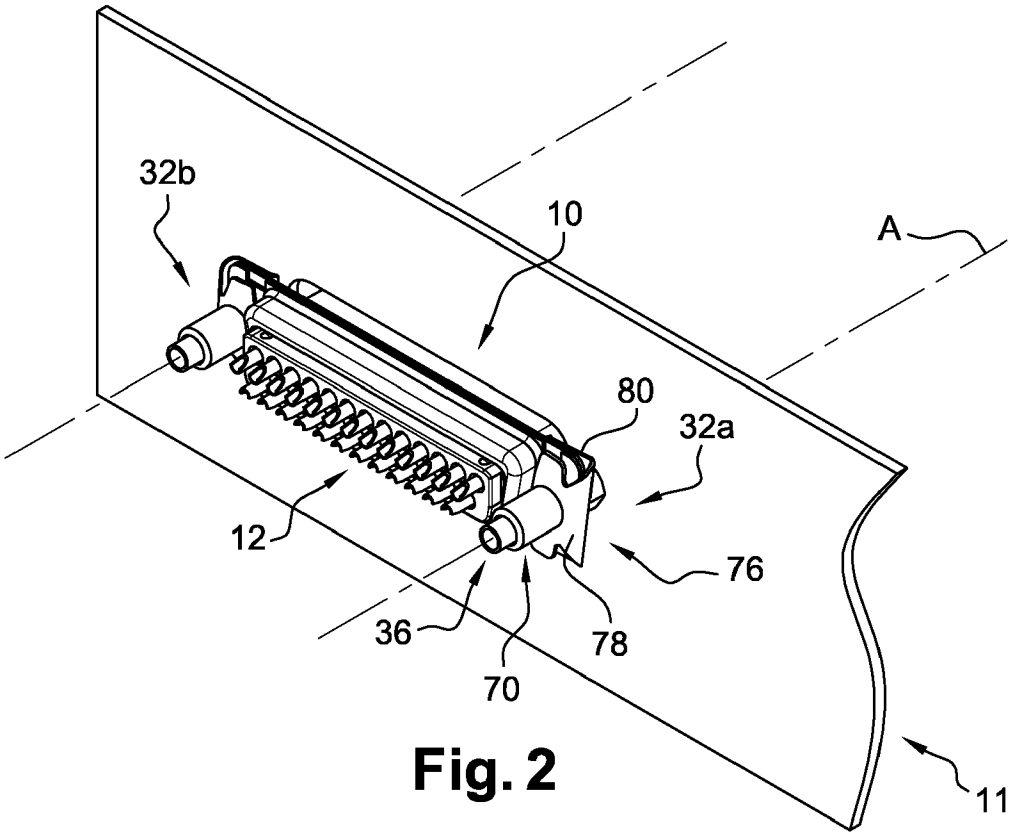
FIG. 2 is a perspective overall view, illustrating the latching device of the FIG. 1, wherein the front and rear connectors are in a connected position.

The attachment means 76, as shown in FIGS. 1 and 2, may comprise a resilient clip 77 which comprises a first rear branch 78 and a second front branch 80 clamping the ear 28*a* of the rear connector 12, so as to attach the sleeve 70 to the rear connector 12.

The rear branch 78 may delimit a hole 81 engaged in the external groove 74 of the sleeve 70 and the front branch 80 is in the shape of a fork extending on both sides of the spacer 54.

Thus, the clip 77 may be mounted on the ear 28*a* by a transversal movement of the clip 77 towards the rear connector 12.

The rear latching element 36 may be mounted movable axially into the sleeve 70, from rear to front, with respect to the rear connector 12, from a rear unlatching position illustrated at FIG. 3, to a front latching position illustrated at FIG. 4.

When the rear latching element 36 is in its rear unlatching position, the protuberance 68 of the rear latching element 36 may abut against the rear abutment face 72 of the sleeve 70 to stop, towards the rear, the stroke of the rear latching element 36.

Moreover, when the rear latching element 36 is in its rear unlatching position, the rear segment 56 may constitute a visual latching indicator that extends axially outside the sleeve 70, and which thus permits to visually check if the front and rear connectors 10, 12 are latched and connected together, or not.

Preferably, the rear segment 56 is coloured differently than the sleeve 70 in order to easily distinguish them from one another when the rear segment 56 extends axially outside the sleeve 70.

Favourably, the sleeve 70 constitutes a guide for the rear latching element 36.

Furthermore, the rear latching element 36 may be enclosed and imprisoned into the sleeve 70, so that the rear latching element 36 cannot be lost. When the rear latching element 36 is in its front latching position, the rear segment 56 may be retracted within the sleeve 70 so that it is not visible from outside.

Moreover, in the front latching position, the annular latching notch 62 of the rear latching element 36 may be engaged in axial abutment against the radial face 52 of the fingers 46 of the front latching element 34, in order to immobilize axially the front and rear connectors 10, 12 together.

The latching device 32*a* may comprise an elastic means 33 for returning automatically the rear latching element 36 to its rear latching position. The elastic means 33, which is here a helical compression spring, may be located within the sleeve 70 and it is axially compressed and interposed between the protuberance 68 of the rear latching element 36 and a between a shoulder 79 arranged close to the front extremity of the sleeve 70.

Favourably, the sleeve 70 may protect the elastic means 33 from external aggressions.

In order to move or displace the rear latching element 36 from its rear unlatching position to its front latching position, the user may push on the rear segment 56 of the rear latching element 36, towards the front.

During the movement of the rear latching element 36 towards the front, the inner part of the front extremity of the rear latching element 36 may slide on the front chamfered face 50 of the fingers 46 and constraints the elastic fingers 46 radially towards the axis A, until the fingers 46 penetrate into the latching housing 60 in such a manner that the radial faces 52 of the fingers 46 abut axially against the notch 62 of the latching element 36.

Figure 5:
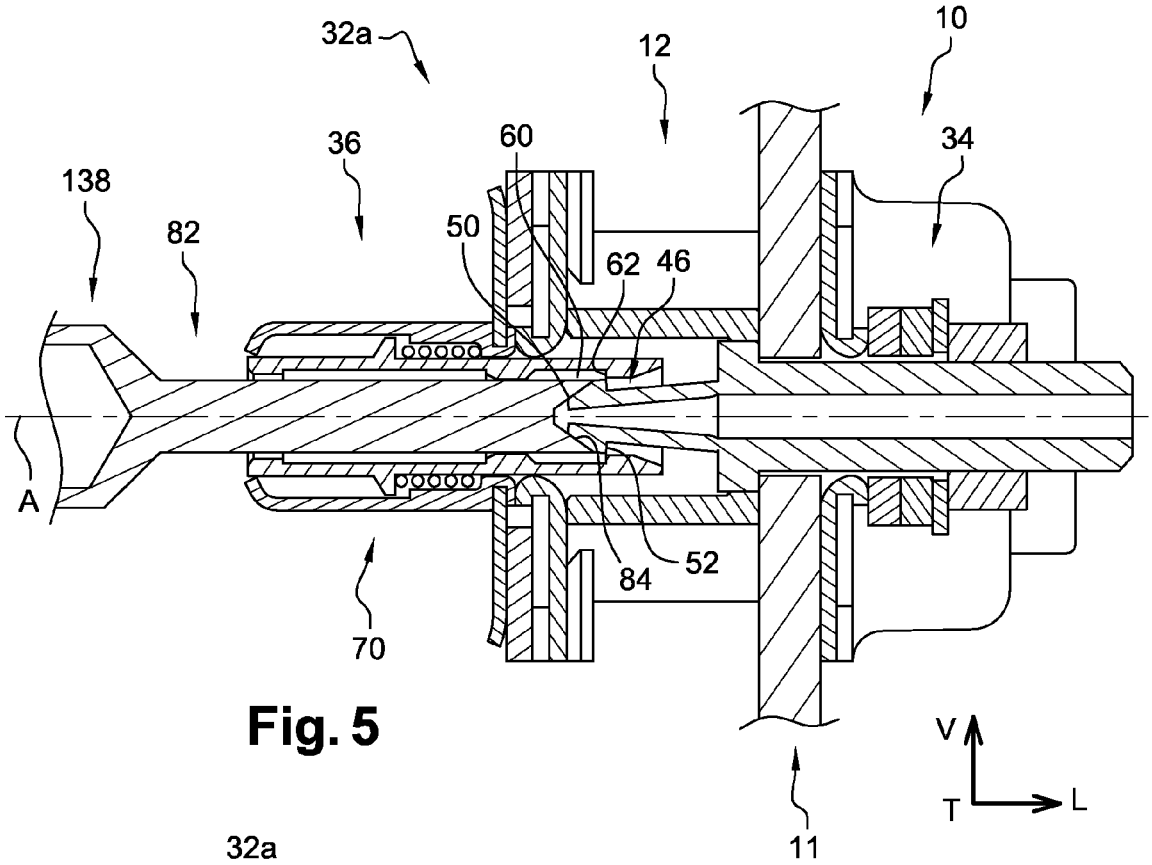
FIG. 5 is a view similar to FIG. 3, illustrating an unlatching tool for unlatching the rear latching element.

The latching device 32*a* may comprise an unlatching tool 82, according to FIG. 5, to unlatch the rear latching element 36 from the front latching element 34. The unlatching tool 82 may comprise a front axial extremity delimiting a conical recess 84 shaped to cooperate with the fingers 46 of the front latching element 34.

In order to move the rear latching element 36 from its front latching position to its rear unlatching position, the user may insert the unlatching tool 82 through the rear latching element 36, so that the conical recess 84 slides on the front chamfered faces 50 of the fingers 46 and constraints the fingers 46 radially towards the axis A in order to disengage the fingers 46 from the latching notch 62 of the rear latching element 36.

When the radial faces 52 of the fingers 46 do not longer abut against the notch 62, according to FIG. 5, the spring 33 may return automatically the rear latching element 36 to its rear latching position.

Figure 6:
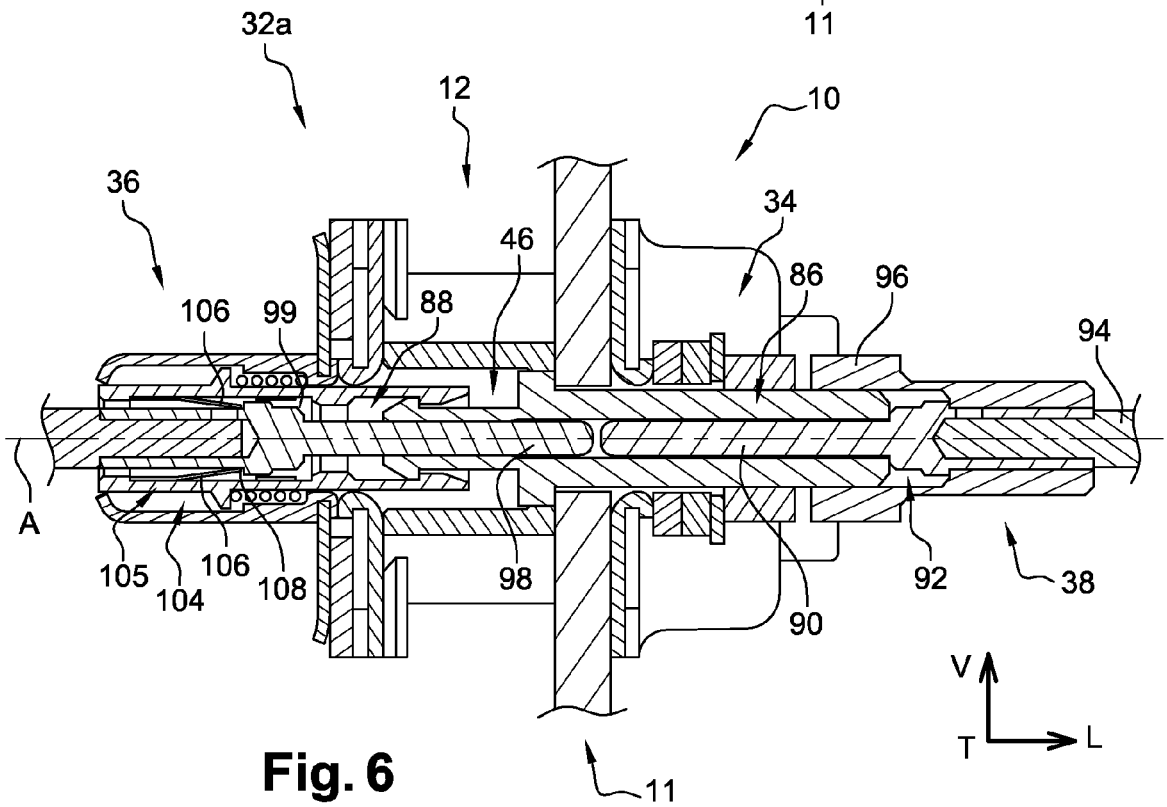
FIG. 6 is a view similar to FIG. 3, illustrating the unlatching device, according to a second embodiment, comprising a first front electrical contact arranged into the front latching element and a second rear electrical contact arranged into the rear latching element.

According to a second embodiment, as illustrated at FIG. 6, the latching device 32*a* may comprise a first front electrical contact 86 and a second rear electrical contact 88. The front electrical contact 86 may comprise a cylindrical pin 90 which is received into the front latching element 34, and a head 92 which is electrically connected to a front wire 94. Moreover, the front electrical contact 86 may be retained on the front latching element 34 by a nut 96 screwed on the threaded fixing segment 38.

Likewise, the rear electrical contact 88 may comprise a cylindrical pin 98 which is received into the rear latching element 36, in such a manner that the axial extremity of the pin 98 is engaged into the front latching element 34, so that the rear electrical contact 88 and the front electrical contact 86 are in electrical contact. For this purpose, the rear electrical contact 88 and the front electrical contact 86 may be directly in touch or they are in electrical contact through the front latching element 34 which, in this case, is made of a conductive material.

Moreover, the rear electrical contact 88 may comprise a head 99 which is connected to a rear wire 102. The rear wire 102 and the front wire 94 are, for example, connected to the ground.

Finally, the device may comprise a retaining means 104 to retain the rear electrical contact 88 into the rear latching element 36. The retaining means 104 may comprise two legs 106 which protrude radially within the rear latching element 36, the two legs 106 being formed upon a cylindrical bushing 105 fixedly arranged into the rear latching element 36.

Each leg 106 may have a natural state, as illustrated at FIG. 6, in which the free extremity of each leg 106 is engaged radially into a corresponding notch 108 of the head 99 of the rear electrical contact 88, in order to axially retain the rear electrical contact 88.

Likewise, each leg 106 may have a deformed state (not illustrated) in which each leg 106 is disengaged from the associated notch 108, in order to release the rear electrical contact 88.

To release the rear electrical contact 88, the user inserts axially a tubular tool (not illustrated) between the front head 99 and the unlatching element 36 so that the tubular tool may deform the legs 106 radially to their deformed state.

According to an alternate and not illustrated embodiment, the electrical contact 86, on the right side of FIG. 6 can be designed in the same manner as the left side contact 88, i.e. without a mounting using a nut 96, bout with a mounting using retaining means similar to the means 104.

Figure 7:
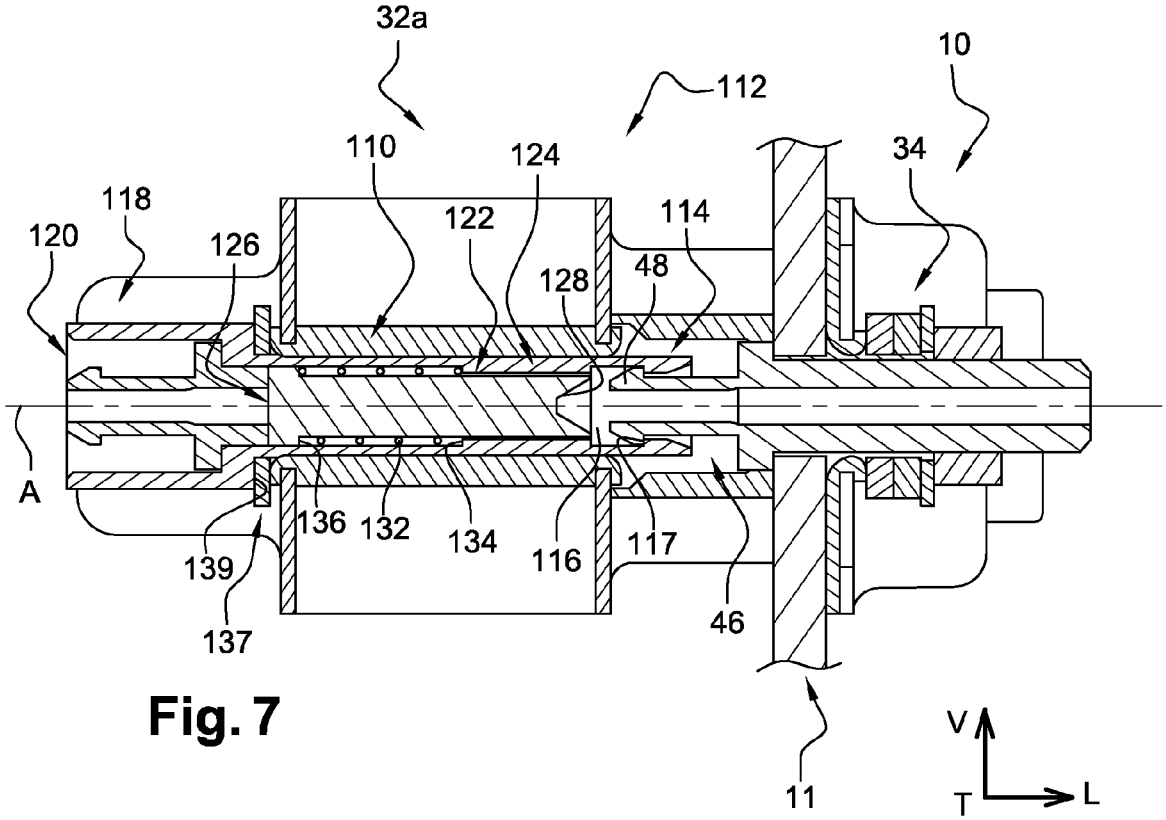
FIG. 7 is a view similar to FIG. 3, illustrating the unlatching device, according to a third embodiment, comprising an intermediate latching element supported by a third intermediate connector and an internal unlatching tool.

According to a third embodiment, as illustrated at FIG. 7, the latching device 32*a* may comprise an intermediate latching element 110 supported by a third "intermediate" connector 112 which is axially interposed between the first and the second connectors 10, 12. The intermediate latching element 110 may comprise a front latching segment 114 which is similar to the front latching segment 58 of the rear latching element 36 and which delimits an intermediate latching housing 116. The intermediate latching housing 116 may form an internal annular latching notch 117 adapted to fit with the fingers 46 of the front latching element 34, in order to immobilize axially the intermediate connector 112 and the front connectors 10 together, according to FIG. 7.

Moreover, the intermediate latching element 110 may comprise a rear latching segment 118 which is similar to the rear latching segment 40 of the front latching element 34 and which defines intermediate latching fingers 120. The intermediate latching fingers 120 may be adapted to fit with the latching housing 60 of the rear latching element 36, with a view to latching the intermediate connector 112 and the rear connector 12 together.

Finally, the intermediate latching element 110 may comprise an axially sliding internal tool 122 which extends axially from a front unlatching extremity 124, to a rear pushing extremity 126. The rear unlatching extremity 124 may delimit a conical recess 128 shaped to cooperate with the fingers 46 of the front latching element 34.

Figure 8:
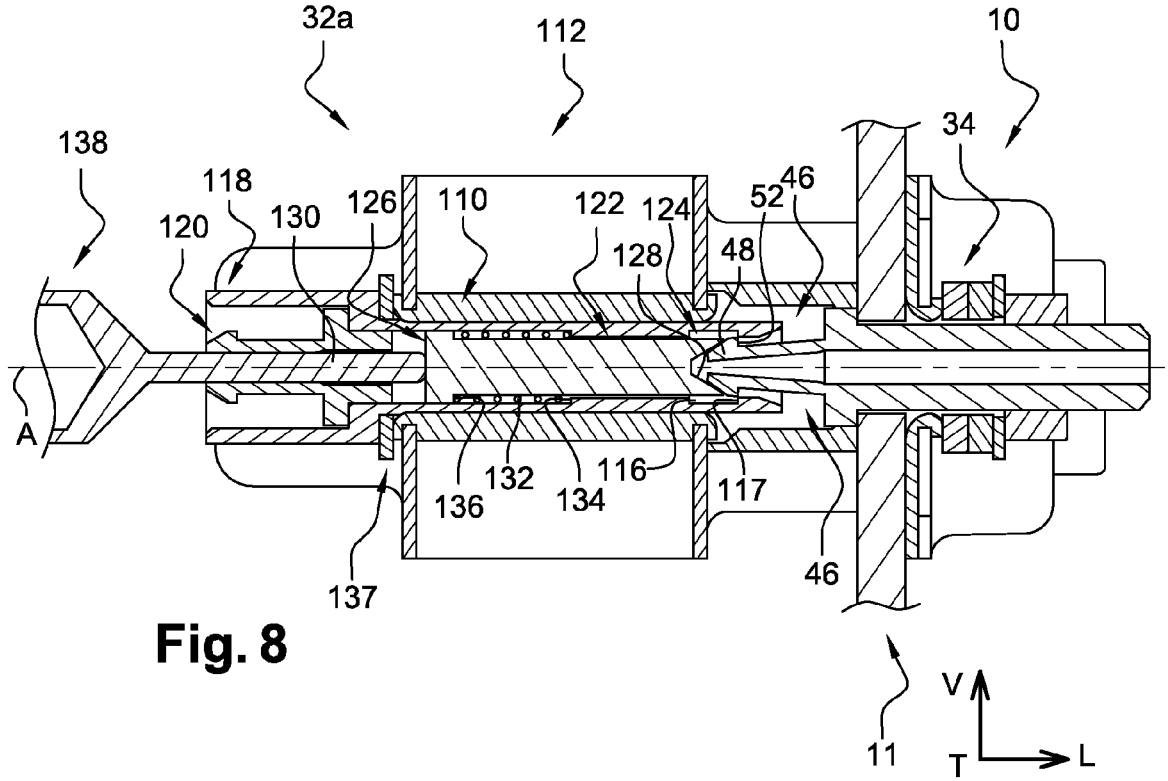
FIG. 8 is a view similar to FIG. 3, illustrating the unlatching device according to the third embodiment of FIG. 7, including a stem in order to move the internal tool towards the front.

The sliding internal tool 122 may be mounted moveable, from rear to front, into the intermediate latching element 110, from a rest rear position, as illustrated at FIG. 7, to an unlatching front position, as illustrated at FIG. 8, in which the unlatching extremity 124 of the internal tool 122 deforms resiliently the fingers 46 of the front latching element 34 to disengage the fingers 46 from the latching notch 117 of the intermediate latching element 110, with a view to unlatching the front connector 10 from the intermediate connector 112.

Moreover, the intermediate latching element 110 may comprise an elastic means 132 for returning the internal tool 122 to its rest rear position. The elastic means 132 may be arranged within the intermediate latching element 110 and it is axially interposed between a first shoulder 134 of the intermediate latching element 110 and a second opposed shoulder 136 of the internal tool 122.

Finally, the intermediate latching element 110 may comprise a spring element, here a spring conical washer 137, which is interposed between a rear radial face of the intermediate connector 112 and a front radial shoulder 139 of the intermediate latching element 110. The spring washer 137 may permit to return the intermediate latching element 110 towards the rear from the intermediate connector 112, when the intermediate latching element 110 and the rear latching element 34 are unlatched, with a view to visually checking if the intermediate latching element 110 and the rear latching element 34 are really unlatched.

In order to move or displace the internal tool 122 towards the front, the user may axially insert a stem 130 into the intermediate latching element 110, so that the stem 130 abuts against the rear pushing extremity 126 of the internal tool 122. When the internal tool 122 moves towards the front, the conical recess 128 of the internal tool 122 may slide on the front chamfered face 50 of the fingers 46 and constraints the fingers 46 towards the axis A to disengage the fingers 46 from the intermediate latching notch 117 of the intermediate latching element 110.

When the tooth 48 of each finger 46 no longer abuts against the notch 117 of the intermediate latching element 110, according to FIG. 8, the elastic means 132 may return the internal tool 122 automatically to its rest rear position.

Figure 9:
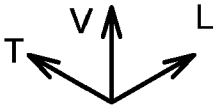
FIG. 9 is a perspective view illustrating a multifunction tool comprising the stem of the FIG. 8 and the unlatching tool of the FIG. 5.
Figure 9:
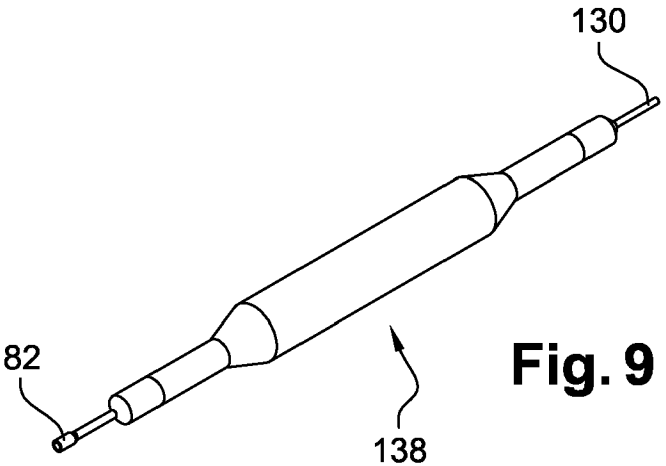

According to FIG. 9, the stem 130 and the unlatching tool 82 may constitute a multifunction tool 138 which a first axial extremity forms the stem 130 and a second opposed axial extremity forms the unlatching tool 82.

According to a non illustrated alternate embodiment of FIGS. 3 and 4, the spacer 54 may be realized as a single piece integral with the segment 38 with the shoulder 41 and the fingers then belong to a central component which is fixed inside the spacer 54.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

The invention claimed is:

1. A latching device for latching a first front connector to a complementary second rear connector, each connector comprising a series of male contact pins and respectively complementary female contact pins, the latching device comprising at least:

a front latching element supported by the front connector, said front latching element comprising a rear latching segment; and a rear latching element supported by the rear connector, the rear latching element comprising a front latching segment and being mounted moveable axially, from rear to front, relatively to the rear connector, from a rear unlatching position to a front latching position in which the front latching segment of the rear latching element cooperates with the rear latching segment of the front latching element to immobilize axially the front and rear connectors together, wherein the latching device comprises:

an axial sleeve supported by the rear connector, the sleeve being opened axially towards the front and the rear, and the rear latching element being mounted movable axially into the sleeve from the rear unlatching position to the front latching position; and elastic means for returning the rear latching element towards its rear latching position, the elastic means being arranged within the sleeve.

2. The latching device of claim 1, wherein the said rear latching element comprises a rear segment forming a visual latching indicator that protrudes axially outside the sleeve when the rear latching element occupies its rear unlatching position, and in that the rear segment is retracted within the sleeve when the rear latching element occupies the front latching position.

3. The latching device of claim 1, wherein the rear latching element delimits a radial protuberance that extends outwardly, the protuberance being in a rear axial abutment against a complementary face of the sleeve, to stop, towards the rear, the stroke of the rear latching element in its rear unlatching position and to imprison the rear latching element into the sleeve.

4. The latching device of claim 1, wherein the rear connector comprises a radial ear delimiting a hole through which the rear latching element slides axially, and in that the sleeve is fixed on the ear by an attachment means in such a manner that the sleeve extends axially rearwards from the hole.

5. The latching device of claim 4, wherein the attachment means comprises a resilient clip comprising a first rear branch and a second front branch, the first and second branches clamping the ear of the rear connector, and in that the sleeve is fixed on the rear branch of the attachment means.

6. The latching device of claim 1, wherein the rear latching segment of the front latching element comprises at least one axial elastic latching finger which delimits a radial tooth, and in that the front latching segment of the rear latching element delimits a complementary housing which is open axially towards the front and which delimits an internal latching notch, the front latching segment of the rear latching element being free to slide axially back and front towards the finger, until the rear latching element occupies its front latching position in which the latching finger is engaged in the latching notch to latch the front connector and the rear connector together.

7. The latching device of claim 6, wherein the rear latching element is hollow and open axially towards the rear and the front, to permit the axial insertion of an unlatching tool through the rear latching element, so that the unlatching tool disengages the latching finger out of the latching notch of the rear latching element, with a view to unlatching the front connector from the rear connector.

8. The latching device of claim 1, wherein the front latching element is open axially at least towards the front to receive a first electrical contact, and in that the rear latching element is open at least towards the rear to receive a second electrical contact, so that the first electrical contact and the second electrical contact are in electrical contact together.

9. The latching device of claim 8, wherein the device comprises means to retain the second electrical contact into the rear latching element, the retaining means comprising at least one leg which protrudes radially within the rear latching element and which has a natural state in which the leg is engaged in a associated notch of the second electrical contact, to axially retain the second electrical contact, and which has a deformed state in which the retaining leg is disengaged from the notch with a view to releasing the second electrical contact.

10. The latching device of claim 6, further comprising an intermediate latching element supported by a third intermediate connector which is axially interposed between the first and the second connectors, the intermediate latching element comprising:

a front latching segment defining an intermediate latching notch fitted to cooperate with the latching finger of the front latching element; and a rear latching segment comprising an intermediate latching finger fitted to cooperate with the latching notch of the rear latching element to latch the connectors together.

11. The latching device of claim 10, wherein the intermediate latching element comprises an axially sliding internal tool mounted moveable from rear to front into the intermediate latching element from a rest rear position to an unlatching front position in which the tool deforms resiliently the latching finger of the front latching element to disengage the said latching finger outside of the intermediate latching notch with a view to unlatch the first connector from the intermediate connector.

12. A latching device for latching a first front connector to a complementary second rear connector, each connector comprising a series of male contact pins and respectively complementary female contact pins, the latching device comprising at least:

a front latching element supported by the front connector, said front latching element comprising a rear latching segment; and a rear latching element supported by the rear connector, the rear latching element comprising a front latching segment and being mounted moveable axially, from rear to front, relatively to the rear connector, from a rear unlatching position to a front latching position in which the front latching segment of the rear latching element cooperates with the rear latching segment of the front latching element to immobilize axially the front and rear connectors together, wherein the latching device comprises an axial sleeve supported by the rear connector, the sleeve being opened axially towards the front and the rear, and the rear latching element being mounted movable axially into the sleeve from the rear unlatching position to the front latching position, and wherein the said rear latching element comprises a rear segment forming a visual latching indicator that protrudes axially outside the sleeve when the rear latching element occupies its rear unlatching position, and in that the rear segment is retracted within the sleeve when the rear latching element occupies the front latching position.

* * * * *